US009050789B2

(12) United States Patent
Demange et al.

(10) Patent No.: US 9,050,789 B2
(45) Date of Patent: Jun. 9, 2015

(54) MACHINE AND METHOD FOR MARKING ARTICLES

(71) Applicant: ILLINOIS TOOL WORKS INC., Glenview, IL (US)

(72) Inventors: Florent Demange, Montreal la Cluse (FR); Vincent Tarnowski, Oyonnax (FR)

(73) Assignee: Illinois Tool Works Inc., Glenview, IL (US)

( * ) Notice: Subject to any disclaimer, the term of this patent is extended or adjusted under 35 U.S.C. 154(b) by 14 days.

(21) Appl. No.: 13/838,115

(22) Filed: Mar. 15, 2013

(65) Prior Publication Data

US 2014/0216284 A1 Aug. 7, 2014

(51) Int. Cl.

| | |
|---|---|
| ***B41F 13/00*** | (2006.01) |
| ***B41F 17/13*** | (2009.01) |
| ***B41F 16/00*** | (2006.01) |
| ***B41F 17/00*** | (2006.01) |
| ***B41F 17/18*** | (2006.01) |

(52) U.S. Cl.

CPC ..... *B41F 17/13* (2013.01); *B41F 16/0026* (2013.01); *B41F 16/0086* (2013.01); *B41F 17/002* (2013.01); *B41F 17/18* (2013.01); *B41P 2217/62* (2013.01)

(58) Field of Classification Search

CPC ..... B41F 17/18; B41F 15/0872
USPC ..... 101/212
See application file for complete search history.

(56) References Cited

U.S. PATENT DOCUMENTS

| | | | | |
|---|---|---|---|---|
| 3,405,633 | A * | 10/1968 | Price, Jr. et al. | 101/37 |
| 4,070,966 | A * | 1/1978 | Edon | 101/269 |
| 4,475,457 | A * | 10/1984 | Davison | 101/228 |
| 5,564,573 | A * | 10/1996 | Palm et al. | 209/518 |
| 5,650,037 | A * | 7/1997 | Larson | 156/540 |
| 5,921,175 | A * | 7/1999 | Bates | 101/32 |
| 6,386,008 | B1 * | 5/2002 | Virtanen et al. | 72/19.8 |
| 6,531,018 | B1 * | 3/2003 | Fiwek | 156/238 |
| 7,823,505 | B2 * | 11/2010 | Paita | 101/38.1 |
| 8,322,279 | B2 * | 12/2012 | Demange et al. | 101/38.1 |
| 2008/0216678 | A1 * | 9/2008 | Stockli | 101/25 |

FOREIGN PATENT DOCUMENTS

| | | |
|---|---|---|
| DE | 19714794 | 10/1998 |
| EP | 2236296 | 10/2010 |
| FR | 2913914 | 9/2008 |

OTHER PUBLICATIONS

ISR and W/O for PCT/US2014/014229 dated May 21, 2014 (11 pgs.).

* cited by examiner

*Primary Examiner* — Anthony Nguyen
(74) *Attorney, Agent, or Firm* — Christopher R. Carroll; The Small Patent Law Group LLC

(57) ABSTRACT

The present invention relates to a machine for marking articles, comprising a marking head suitable for applying a marking force on an article along a marking axis. The marking head comprises a carriage movable in translation along the marking axis and along a transverse axis, which is perpendicular to the marking axis (X10). The marking head also comprises a first roller and a second roller carried by the carriage, rotatable respectively around a first axis and a second axis each located in a plane perpendicular to the marking axis. The rollers are capable of alternately marking the same article or two successive articles, depending on movements of the carriage. The invention also relates to a method for marking articles.

19 Claims, 6 Drawing Sheets

MACHINE AND METHOD FOR MARKING ARTICLES

CROSS-REFERENCE TO RELATED APPLICATIONS

This application claims priority to French patent application 1350938, filed on 4 Feb. 2013, and titled "MACHINE ET PROCÉDÉ DE MARQUAGE D'ARTICLES," the entire disclosure of which is incorporated by reference.

TECHNICAL FIELD

The present invention relates to a machine and a method for marking articles, in particular by hot stamp marking. The field of the invention is that of marking articles such as containers, for example bottles or flasks.

BACKGROUND

In a known manner, a marking machine includes a marking head fitted with at least one marking member, of the roller or punch type. The marking head is configured to apply a marking force on an article, by means of the marking member, in particular with the interposition of a marking tape which makes it possible to create a pattern on the outer surface of the article.

In the case of marking by hot stamping by means of a silicone rubber roller, this roller is surrounded by heating means, such as heating tiles. In order for the roller to get heated in a satisfactory manner between the marking of two articles, the roller must have dimensions larger than the dimensions of the article to be marked, for example, about three times greater. For example, if the article is a glass bottle having a diameter equal to 85 millimeters (mm), the roller has a diameter of the order of 260 mm. These dimensions are relatively large, which complicates the manufacture and assembly of the roller on the marking head and increases the cost of the machine.

BRIEF SUMMARY

One aspect of the present invention is to provide an improved machine and method for marking an article, in particular by the hot stamping process.

To this end, the invention relates to a machine for marking articles, comprising a marking head suitable for applying a marking force on an article along a marking axis, the marking head comprising a carriage movable in linear direction along the marking axis and along a transverse axis which is perpendicular to the marking axis. The marking head also comprises a first roller and a second roller carried by the carriage, rotatable respectively about a first axis and a second axis each located in a plane perpendicular to marking the axis, the rollers being capable of alternately marking the same article or two successive articles, depending on the movements of the carriage.

Thus, the invention makes it possible to simplify the manufacture and assembly of the rollers on the marking head, as well as to reduce their mass and size, as compared with a single roller of far greater dimensions. For example, a roller having a diameter of the order of 260 mm is replaced with two rollers each having a diameter of about 130 mm. These two rollers are lighter than a large diameter roller, such that the machine can achieve much higher marking speeds. In addition, the two rollers offer far greater versatility depending on different applications and the shape and form of articles to be marked.

The machine may also include a system for dispensing the marking tape between the marking head and the article. Alternatively, the machine may include a system for dispensing labels, in particular labels that are thick and/or made of metal, between the marking head and the article. In this case, the machine is a machine for marking articles by labelling.

According to other advantageous characteristic features of the machine according to the invention, taken individually or in combination:

The first roller and the second roller are offset in relation to each other in a direction parallel to the first axis and the second axis, and each roller is capable of marking a different part of a same article in a longitudinal direction of the article.

The marking machine also comprises a system for dispensing two distinct marking tapes between the article and the first roller or the second roller, respectively.

The first roller and the second roller are aligned with each other along a direction perpendicular to the first axis and the second axis and alternatingly mark the same part of two successive articles, defined along their longitudinal direction.

The carriage is movable along the marking axis alternatingly over a first distance for the first roller and a second distance for the second roller, the first distance being different from the second distance, and each roller is capable of marking an area of an article having different dimensions from another area of that article to be marked by the other roller, in particular a different diameter.

The first axis and second axis are situated in the same plane perpendicular to the marking axis.

The marking head also comprises means for heating the first roller and the second roller, for examples heating tiles, arranged in the carriage.

The invention also relates to a method for marking articles, under the action of a marking head adapted to apply a marking force on an article along a marking axis, the method comprising at least the following successive steps:

a step of positioning a first article facing the marking head, a step of marking the first article under the action of the marking head, a step of positioning a second article facing the marking head;

a step of marking the second article under the action of the marking head.

In an embodiment of the method, in the marking steps a2) and b2), a first roller and a second roller fitted to the marking head both alternately mark each article or each alternately marks one article out of two.

According one particular embodiment, the first roller and the second roller are offset relative to one another along a direction parallel to the first axis and to the second axis and each roller marks a different part of the same article in each marking step a2) and b2).

According to another particular embodiment, the first roller and the second roller are aligned with one another along a direction perpendicular to the first axis and to the second axis and alternately mark the same part of successive articles, defined along their longitudinal direction, in the successive marking steps a2) and b2).

According to another particular embodiment, the first roller and the second roller are aligned with each other along a direction perpendicular to the first axis and to the second axis and alternately mark two different areas of the same article in each marking step a2) and b2), these two different areas being situated in the same part of the article defined along a longitudinal direction of the article and having different dimensions, in particular different diameters.

BRIEF DESCRIPTION OF THE DRAWINGS

The invention will be better understood upon reading the description which follows, given by way of non-limiting example and with reference made to the accompanying drawings in which.

DETAILED DESCRIPTION

Figure 1:
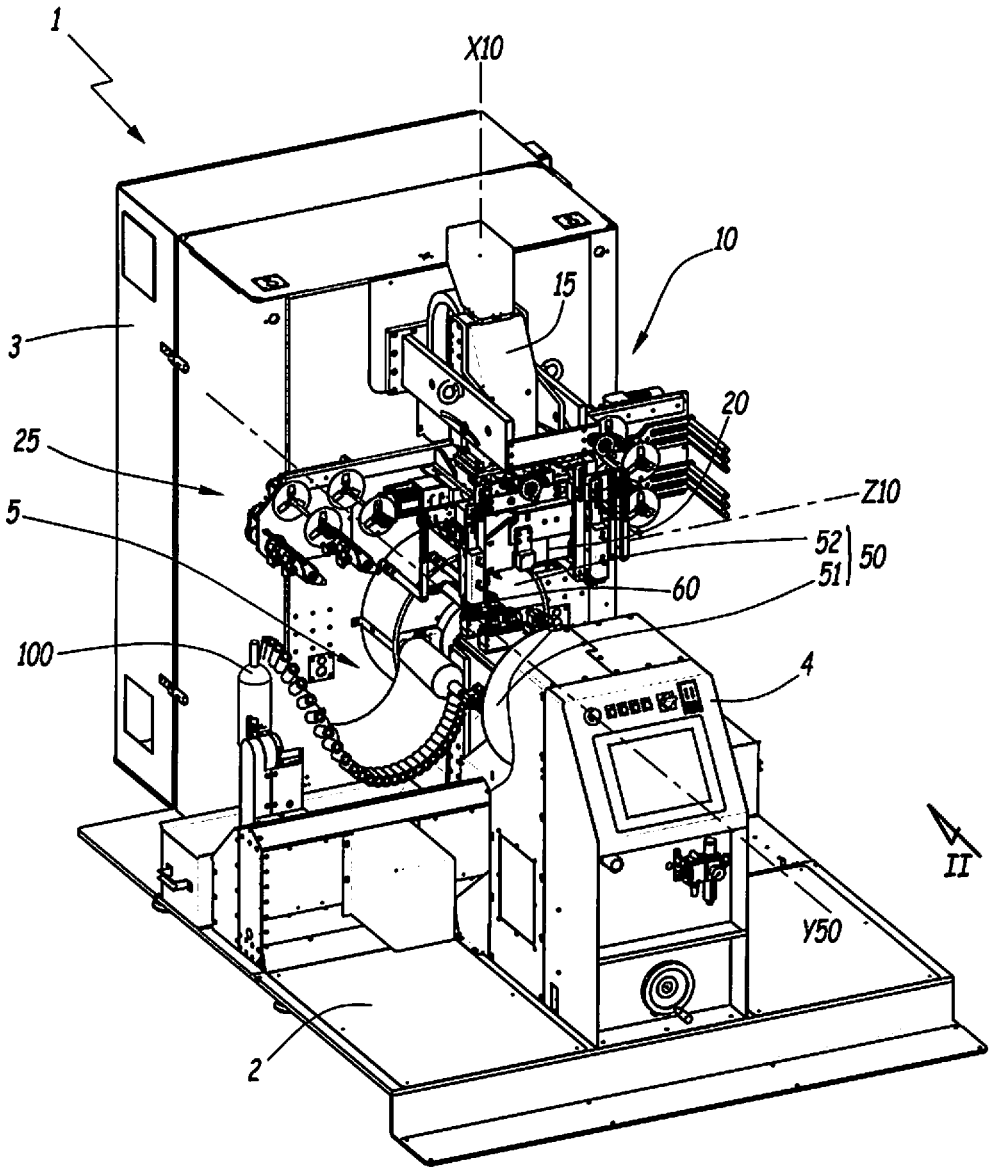
FIG. 1 is a perspective view of a marking machine according to the invention.

FIGS. 1 to 6 show a machine 1, according to the invention, for marking articles 100.

The machine 1 is intended to be used for decorating articles 100 by way of applying a marking on the external surface. In particular, the machine 1 is suitable for the hot stamp marking of these articles 100.

The machine 1 comprises a base 2 for ground anchoring, an electrical cabinet 3, a control station 4, a system 5 for feeding the machine 1 with articles 100, a marking head 10, a system 50 for positioning of articles 100 so as to face the marking head 10, as well as a system 60 for supporting the article 100 during the marking process. The housing for the electrical cabinet 3 and the housing for the control station 4 are fixed at the base 2. The machine 1 also comprises a system for unloading the articles 100 marked, this system is not shown for the sake of simplification.

Figure 5:
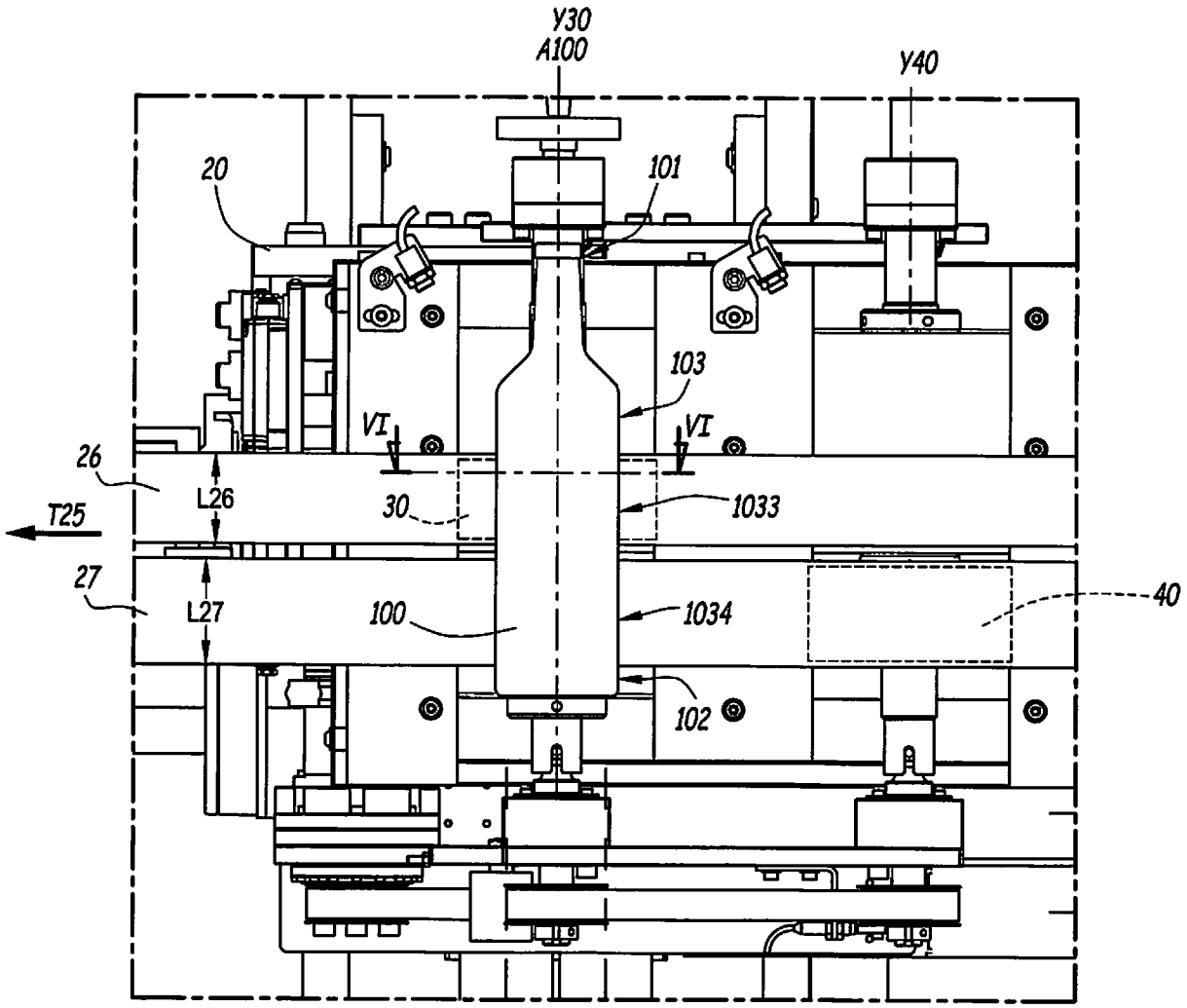
FIG. 5 is a view on an enlarged of the detail V in FIG. 3.

In the example in FIGS. 1 to 6, the articles 100 are bottles with a rotationally symmetrical shape. The bottles 100 extend along a central axis A100 between a neck 101 and a rear end 102, or bottom, opposite the neck 101. The bottles 100 have a body 103 of generally cylindrical shape with a circular cross section centred on the axis A100. By way of non-limiting example, the diameter of the body 103 is of the order of 85 millimeters. The outer surface of the body 103 is intended for receiving the marking. More specifically, the body 103 may include various parts 1033 and 1034, defined along a longitudinal direction of the body 103, and each intended to receive a marking specific thereto, as shown in FIG. 5.

Figure 2:
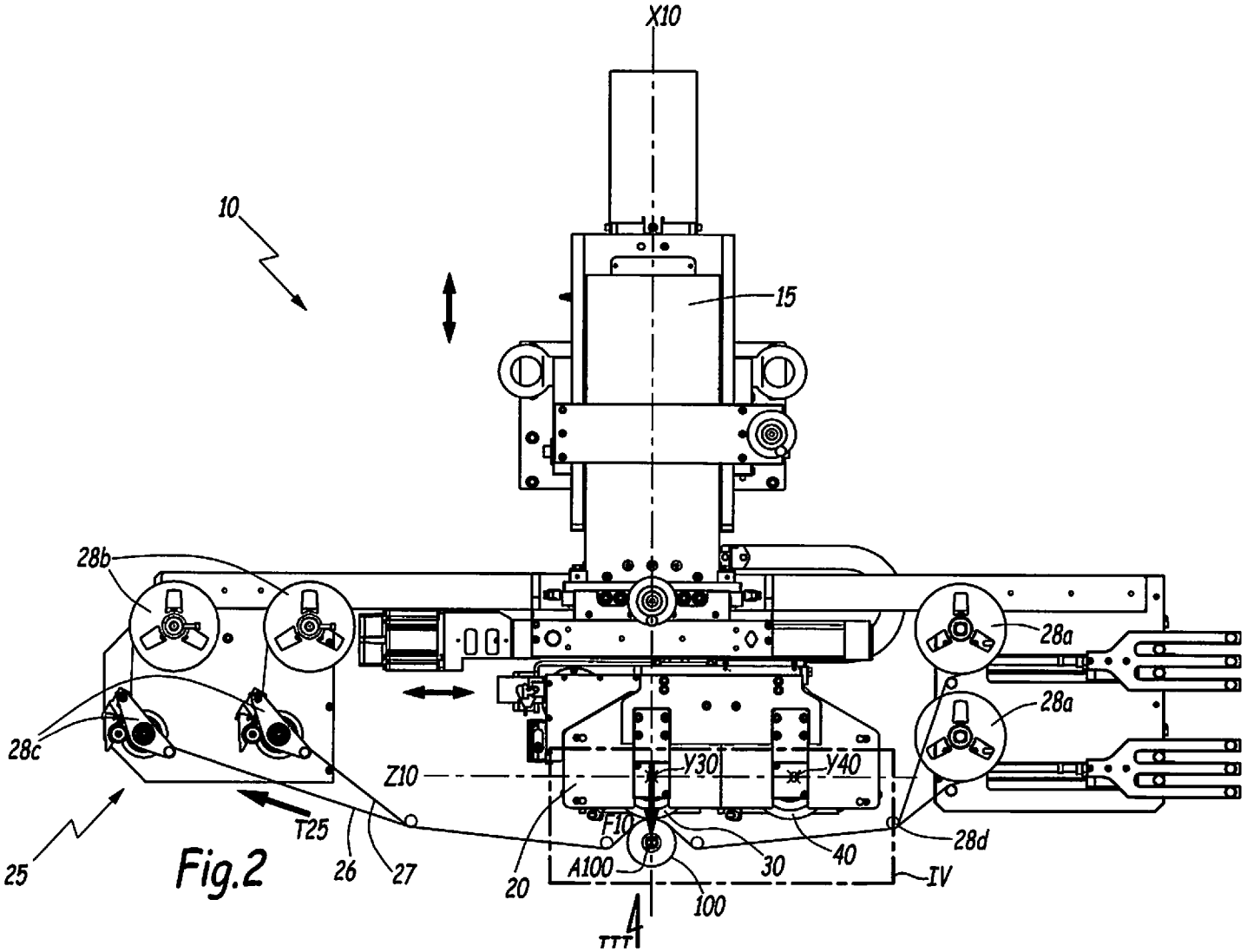
FIG. 2 is a partial view of the machine along the direction of arrow II in FIG. 1, on an enlarged scale, showing a marking head.

As shown in FIGS. 1 and 2, the marking head 10 includes a carriage 15 movable relative to the housing for the electrical cabinet 3 along a vertical marking axis X10, a carriage 20 movable relative to the carriage 15 along a horizontal axis Z10, a system 25 for dispensing marking tapes 26 and 27, as well as two marking rollers 30 and 40 mounted so as to pivot on the carriage 20. The carriage 20 is movable in linear direction selectively along the axis X10 and along the axis Z10, perpendicular relative to each other. Advantageously, the carriage 20 or at least a portion of the carriage 20 including rollers 30 and 40 is removable so as to enable the modification in a simple manner of the configuration of the marking head 10.

The marking head 10 is configured to apply a marking force F10 on an article 100 along the axis X10, under the pressure of one of the rollers 30 or 40. For the intended applications, this marking force F10 may be very significant, for example in the order of 12 000 Newtons. Under these conditions, the support system 60 is used to define a reference position for the article 100 along the axis X10 and counter the marking force F10, as detailed here below.

The marking head 10 also comprises the means for heating the rollers 30 and 40, for example heating tiles, arranged in the carriage 20 around each of the rollers 30 and 40. Thus, the rollers 30 and 40 may be heated with a view to carrying out the marking by hot stamping of the articles 100.

The roller 30 includes a peripheral part 31 made of silicone, resiliently deformable during the marking of the article 100 as well as a rigid inner part 32 for example made of metal. Similarly, the roller 40 includes a peripheral part 41 made of silicone, resiliently deformable during the marking of the article 100 as well as a rigid inner part 42, for example made of metal. The diameter of each of the rollers 30 and 40 is preferably greater than or equal to the diameter of the body 103 of the article 100, for example of the order of 130 mm. The implementation of the two rollers 30 and 40 is more convenient and less expensive than a single larger diameter roller. These rollers 30 and 40 are simpler to fabricate as consumables and easier to handle and manipulate during manufacture or maintenance of the machine 1. These rollers 30 and 40 are lighter than a single roller of greater diameter, such that the overall mass of the marking head 10 is reduced. The machine 1 is therefore able to achieve higher marking speeds.

The roller 30 is rotatable about an axis Y30, while the roller 40 is rotatable about an axis Y40. The axes Y30 and Y40 are parallel and fixed relative to the carriage 20 and each is situated in a plane perpendicular to the axis X10. The rollers 30 and 40 are offset in relation to one another along a direction parallel to the axis Z10. In the example in FIGS. 1 to 6, the axes Y30 and Y40 lie in the same plane containing the axis Z10, in other words they are situated at the same height in the vertical direction defined by the axis X10. Alternatively, the rollers 30 and 40 may be offset in relation to each other in the vertical direction defined by the axis X10, such that the axes Y30 and Y40 are situated in different planes perpendicular to the axis X10 and mutually parallel.

The marking head 10 comprises a drive motor with digital control for the rollers 30 and 40, which is arranged in the carriage 20. During marking, this motor causes the roller 30 or 40 to pivot about the respective axis Y30 or Y40 following a rotational movement R10, shown by an arrow in FIGS. 4 and 6, in the direction opposite to that of the article 100 but with the same linear velocity at their interface. Alternatively, each roller 30 and 40 may be equipped with its own drive motor.

Depending on the movements of the carriage 20 and the articles 100 within the machine 1, the two rollers 30 and 40 are adapted for marking in alternating fashion the same article 100, each acting in turn. During application of the marking force F10 by the roller 30 on the article 100, the axis Y30 is positioned in front of the axis X10, that is to say that the axes X10 and Y30 are perpendicular in the same vertical plane. During application of the marking force F10 by the roller 40, the axis Y40 is positioned in front of the axis X10, that is to say that the axes Y40 and X10 are perpendicular in the same vertical plane.

As shown in FIG. 2, within the dispensing system 25, each tape 26 and 27 travels from a supply reel 28*a* to a collecting reel 28*b*, under the action of a pulling device 28*c*. Return rollers 28*d* schematically represented for the purpose of simplification, are used to define the path of travel of the tapes 26 and 27 between the reels 28*a* and 28*b*, the rollers 30 and 40 and the article 100. The tape has a width L26, while the tape 27 has a width L27, in the direction defined parallel to the axes Y30 and Y40. The dispensing system 25 is configured to run tapes 26 and 27 in parallel between the article 100 to be marked and, respectively, the roller 30 or the roller 40, in the direction shown schematically by an arrow T25 in FIGS. 2 to 6. The running of the tapes 26 and 27 is synchronized with the movement of rollers 30 and 40. Alternatively, the system 25 can distribute a single tape 26, alternately pressed by the rollers 30 and 40 on the article 100 to be marked.

Figure 3:
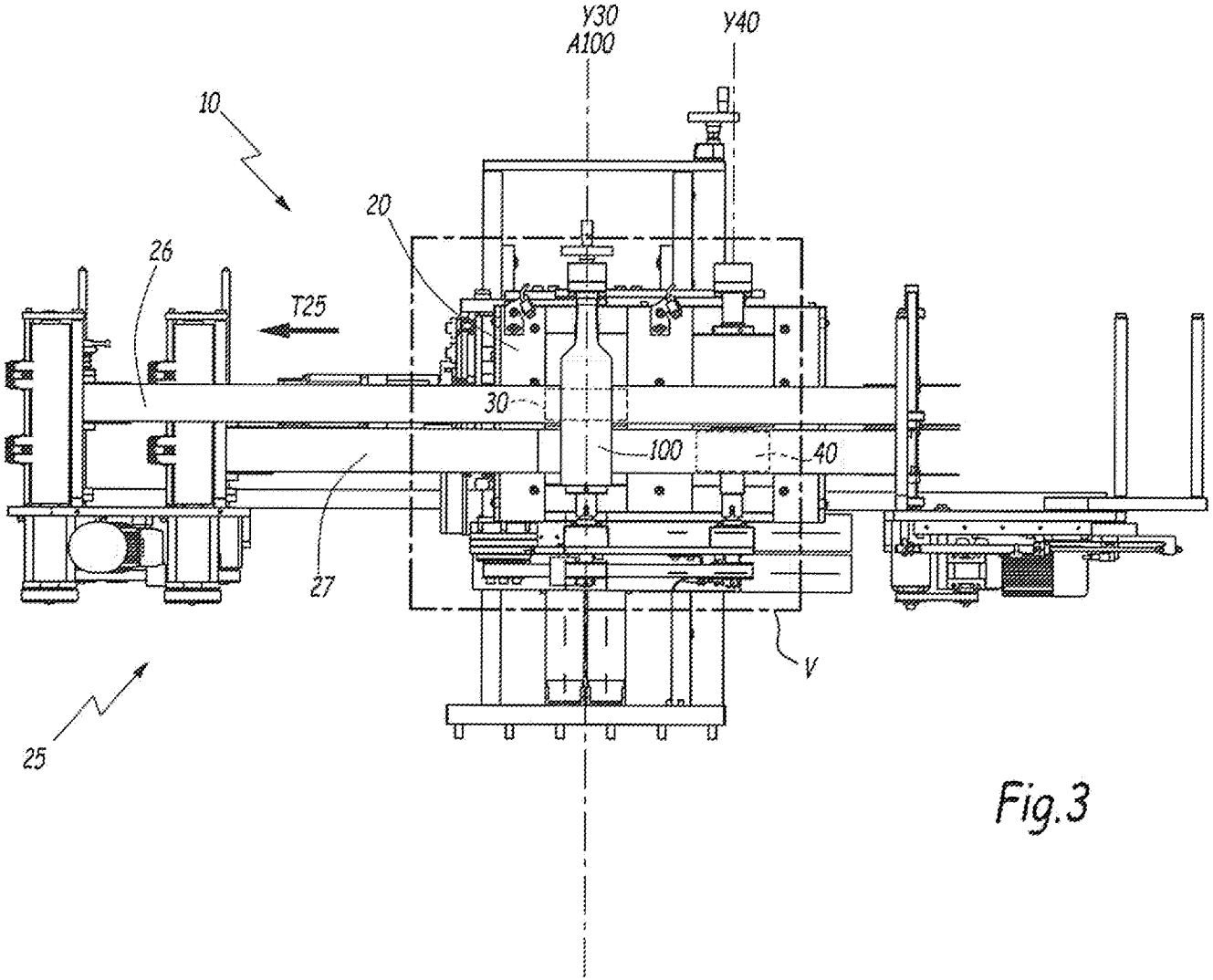
FIG. 3 is a view along arrow III in FIG. 2.
Figure 4:
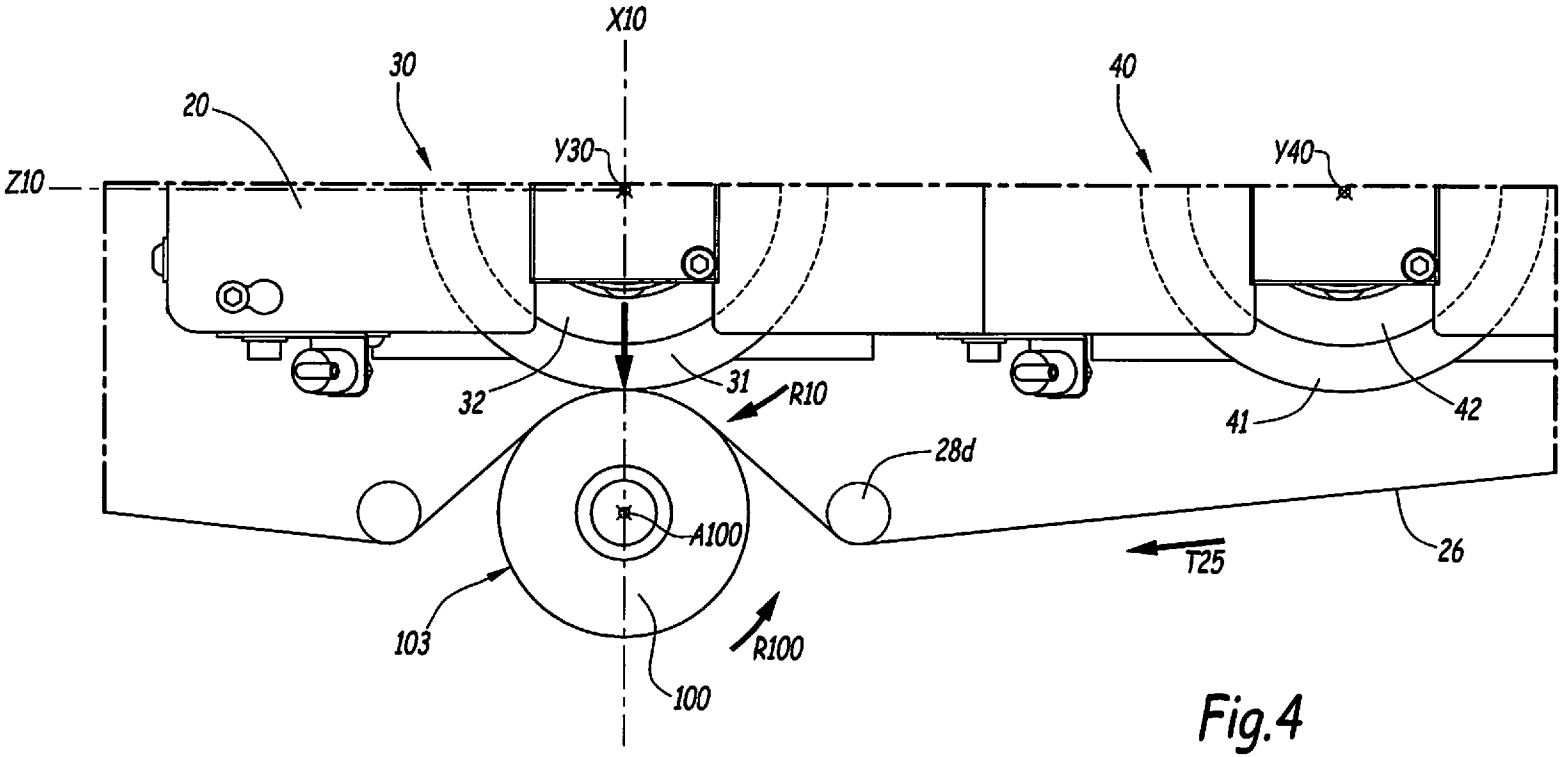
FIG. 4 is a view on an enlarged of the detail IV in FIG. 2.

As shown in FIGS. 3 and 5, the rollers 30 and 40 are offset relative to each other in a direction parallel to the axes Y30 and Y40, such that each roller 30 and 40 is able to mark a different part 1033 or 1034 of the same article 100. The roller 30 presses the tape 26 against the part in 1033, while the roller 40 presses the tape 1034 against the part 1034.

Comparatively, in the case of a marking head 10 comprising a single roller, the marking of two different parts 1033 or 1034 of the same article 100 is more complex. For example, the carriage 20 or the system 50 for positioning the article 100 should be movable along a direction parallel to the axis of rotation of the roller, in other words a direction perpendicular to the plane defined by the axes X10 and Z10, which adds complexity to the machine 1 and increases cost of the machine 1.

The machine 1 makes it possible to carry out the marking of two different parts 1033 and 1034 of the same article 100 with simplicity and speed. Each of the rollers 30 and 40 fitted to the marking head 10 has sufficient time to get heated up before marking subsequent article 100.

Moreover, the marking head 10 may be configured so as to mark different parts of an article 100 having different dimensions, in particular different diameters in the context of a bottle of generally stepped cylindrical shape. According to a first configuration, the axes Y30 and Y40 of the rollers 30 and 40 are located in the same plane perpendicular to the axis X10, while the carriage 20 is movable along the axis X10 alternately along a first distance for the first roller 30 and a second distance for the second roller 40 in view of the marking. The first distance is different from the second distance. In other words, depending upon the movements of the carriage 20 along the axis X10, the two rollers 30 and 40 descend to different levels along the axis X10 to mark the article 100. The speed of rotation R10 of each of the rollers 30 and 40 is different because the marking is done at different levels. According to a second configuration, the axes Y30 and Y40 of the rollers 30 and 40 are offset in relation to each other in the direction defined by the axis X10, while the carriage 20 is movable along the axis X10 by the same distance for the two rollers 30 and 40 in view of the marking.

The first configuration is conveniently more practical because it requires only the adjustments of the movements of the carriage 20 during the changing of a batch of articles 100, while the second configuration requires the mechanical adjustment of the relative position of the rollers 30 and 40 on the carriage 20. Thus, according to one or the other configuration, each roller 30 and 40 may mark a part of this article 100 having dimensions that are different from another part of this article 100 to be marked by the other roller, in particular a different diameter.

As shown in FIG. 1, the system 50 of transport and positioning of articles 100 includes a front platen 51 mounted so as to be movable relative to the housing of the control station 4 and a rear platen 52 mounted so as to be movable relative to the housing of the electrical cabinet 3. The housing of the control station 4 is shown partially torn in FIG. 1 in order to better show the platen 21. In practice, the platens 51 and 52 are rotationally movable about a horizontal axis of rotation Y50, in a synchronized manner with each other by means of mechanical or digital connection. This synchronized rotation may be alternating or continuous depending on the application and the configuration of the machine 1. The axis Y50 is perpendicular to the axis X10 and parallel to the axes Y30 and Y40. The support system 60 is disposed between the platens 51 and 52 along the front-rear direction, defined in a parallel manner to the axis Y50. When the platens 51 and 52 pivot about the axis Y50, support system 60 does not pivot.

According to the embodiment in FIGS. 1 to 6, the machine 1 comprises four distinct transport and marking stations. In other words, the positioning system 50 includes potential transport means for four articles 100. In practice, the four stations of the positioning system 50 may have up to three articles 100 simultaneously: one article 100 received from the feeding system 5 prior to marking, one article 100 in process of being marked by the marking head 10 and one article 100 already marked being sent to the unloading system. The last station, close to the base 2 during the rotation of the platens 51 and 52 around the axis Y50 does not transport any articles 100. The front platen 51 includes four front carriage turrets, while the rear platen 52 includes four rear carriage turrets. Except for the synchronized rotation around the axis Y50, the component members of the positioning system 50 are independently movable radially to axis Y50 radial to the axis. When the marking station is positioned facing the marking head 10, each front and rear carriage turret has a degree of freedom along a defined direction parallel to the axis X10 and the marking force F10.

In practice, the front carriage-turret may be provided with a tailstock adapted to be lodged in the neck 101 formed at the front end of article 100, while the rear carriage turret is provided with a catch bottom for the rear end 102 of the article 100. The tailstock and the bottom form the means for supporting the ends of the article 100 during transport, positioning, and marking of the article 100. The rear carriage turret comprises a geared motor unit for driving the rotation of the bottom supporting the rear end 102 of the article 100. This device is configured so as to pivot the article 100 along a rotational movement R100, represented by an arrow in FIGS. 4 and 6, about the axis A100 of the article 100 during the application of the marking force F10. The direction of rotation R100 of the bottom and of the article 100 is opposite to the direction of rotation R10 of the marking roller 30. The rotations R10 and R100 are synchronized with the same linear velocity at their contact interface. In addition, one of the carriages turrets may have a degree of freedom along the front-rear direction parallel to the axis Y50, in a manner so as to compensate for the length defects of the article 100 along the axis A100. For example, a spring may be disposed between the tailstock and a fixed member of the front carriage turret.

Before marking, once the positioning system 50 has brought the article 100 to a position in front of the marking head 10, the support system 60 comes to bear against the article 100.

Figure 6:
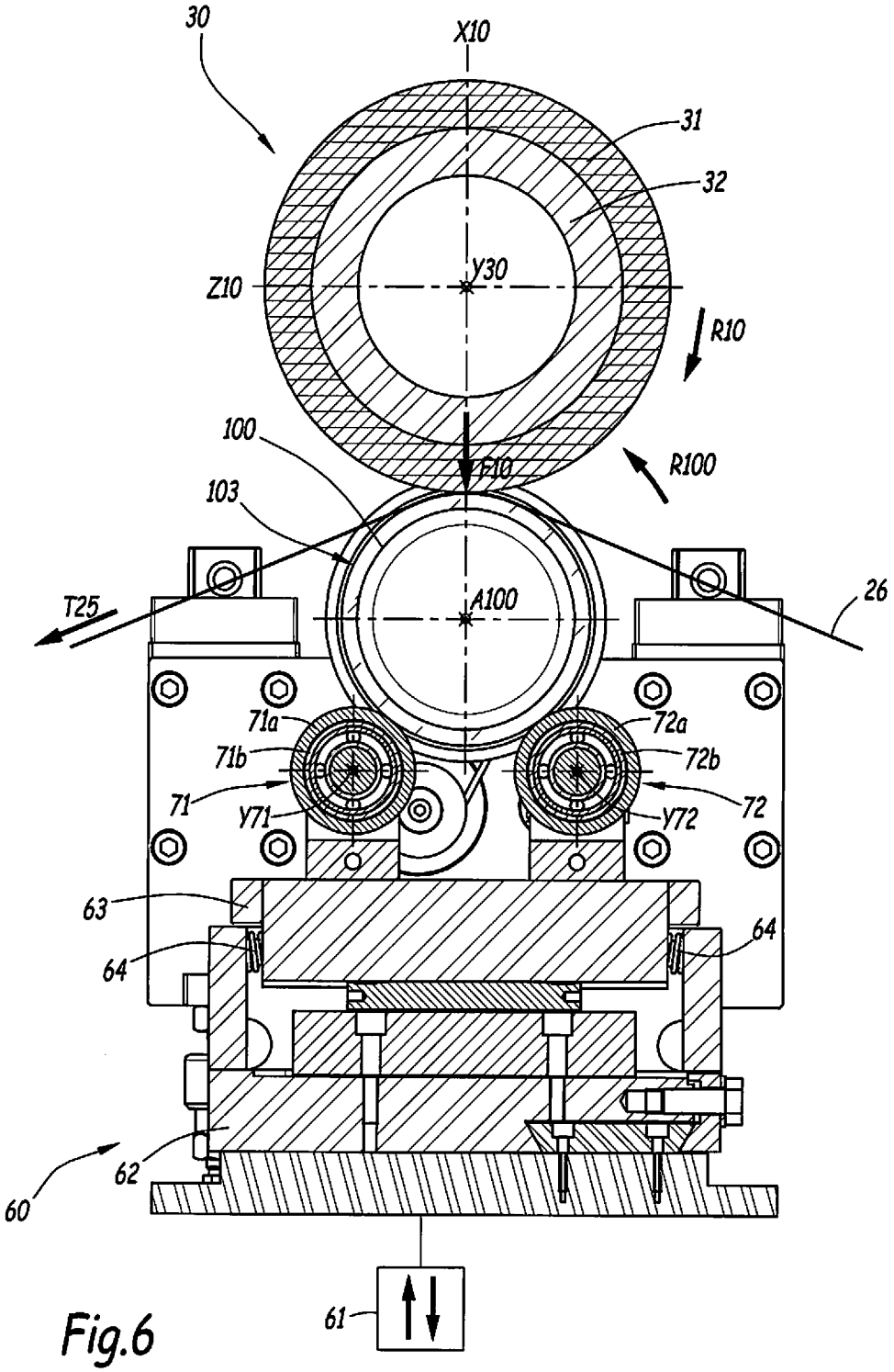
FIG. 6 is a cross section along the line VI-VI in FIG. 5, showing in addition a support system for an article to be marked.

As shown in FIG. 6, the support system 60 comprises a vertical linear movement device 61, a support base 62, adjustable blocks 63, springs 64 disposed between the base 62 and the blocks 63 as well as the support rollers 71 and 72 mounted in pairs on each block 63. In a manner not visible in the cross section in FIG. 6, the support system 60 includes two blocks 63 and thus two pairs of rollers 71-72. The device 61 is schematically shown for the purposes of simplification. The support base 62 is interposed between the device 61 on the one hand and the blocks 63 on the other. The four rollers 71 to 72 are capable of receiving the article 100 bearing thereon, before and during the application of the marking force F10.

The device 61 comprises a digital control motor and means for transmitting movement to the base 62. The device 61 is designed to move the base 62 along the vertical direction defined by the axis X10, in particular by bringing the base 62 closer to the marking head 10 when the article 100 supported by the system 50 is positioned opposite the marking head 10. In practice, the base 62, the blocks 63 and the rollers 71 to 72 are moved by the device 61 by a predetermined distance, for example of the order of five millimeters in the direction of the marking head 10. The article 100 comes to bear on the rollers 71-72 and is moved in the direction of the marking head 10, thanks to the degree of freedom of the carriages turrets along the direction parallel to the axis X10. After this movement, the support system 60 defines a reference position for the article 100 along the axis X10, prior to the application of the marking force F10. More specifically, the reference position is defined by the rollers 71-72. Preferably, during the marking, the device 61 exerts on the base 62 a force opposite to the force F10, so as to maintain the reference position defined by the rollers 71-72

The roller 71 includes an outer peripheral part 71*a* made of polyurethane, resiliently deformable during the marking of the article 100, as well as a rigid inner part 71*b*, for example made of metal. Advantageously, the outer part 71*a* has a hardness less than that of the article 100 and greater than that of the outer parts 31 and 41 of the marking rollers 30 and 40. Thus, the outer part 71*a* does not cause any damage to the article 100 and any eventual decorative embellishments or prior varnishing while ensuring the reference position. The roller 71 is rotatable relative to the block 63 about a horizontal axis Y71. The description provided above with reference made to the roller 71 also applies to the roller 72, which includes an outer peripheral part 72*a* made of polyurethane and is rotatable about a horizontal axis Y72 parallel to the axis Y71. The centre to centre spacing between the rollers 71 and 72 is constant during the marking. This spacing can be adjusted when the machine 1 is not in operation, in particular so as to accommodate the particular dimensions of a new batch of articles 100 to be marked.

Two springs 64 are interposed between each block 63 and the base 62. The springs 64 are compressible/extensible along a direction defined as parallel to the horizontal axis Z10. The springs 64 shown are mechanical, however, an alternative support system can be equipped with pneumatic springs. The springs 64 constitute the backlash means for the support system 60 along this horizontal direction defined by the axis Z10. More specifically, the springs 64 constitute backlash means for each block 63, and thus each pair of rollers 71-72, along this horizontal direction defined by the axis Z10, perpendicular to their respective axes Y71 and Y72. When the article 100 comes to bear against the rollers 71-72, the springs 64 allow each pair of support rollers 71-72 to move in linear direction parallel to the axis Z10, independently of the other pair of rollers. Thus, the rollers 71-72 remain in contact with the article 100 despite shape defects of the article 100 and deformities, prior to marking and during marking of the article 100.

Moreover, the machine 1 may be shaped differently from the FIGS. 1 to 6 without departing from the scope of the invention. In particular, the marking head 10, the positioning system 50 and the support system 60 may be shaped differently.

According to a particular variant not shown, the rollers 30 and 40 are not offset in relation to each other in the direction parallel to the axes Y30 and Y40. In other words, the rollers 30 and 40 are aligned in a direction perpendicular to the axes Y30 and Y40. The dispensing system 25 is configured so as to run a single marking tape 26 between the article 100 to be marked and the rollers 30 and 40. Depending on the movements of the carriage 20 and the articles 100 within the machine 1, the two rollers 30 and 40, each acting in turn, may mark in alternating fashion, either the same article 100 or one article 100 out of two. The rollers 30 and 40 that are aligned are thus not suitable for marking different parts along the longitudinal direction of this same article 100, unless the carriage 20 and/or the article 100 are movable along a direction parallel to the axes Y30 and Y40, which would add complexity to the machine 1.

When the rollers 30 and 40 are aligned and mark the same article 100, they may nevertheless still mark in alternating fashion two different areas of the article 100, generally located in the same part defined along the longitudinal axis A100 of the article 100, but having different dimensions, in particular different diameters. By way of a non-limiting example, the same part of the article 100 may include a circle formed with excess thickness, as well as a cavity formed inside the circle. The circle may have dimensions generally larger than the diameter of the article 100 radially to the axis A100, while the cavity may have overall dimensions less than or equal to the diameter of the article 100 radially to the axis A100. The roller 30 marks the circle, while the roller 40 marks the cavity by descending to different levels along the axis X10 so as to mark article 100, as described above in connection with the embodiment in FIGS. 1 to 6. The speed of rotation R10 of each of the rollers 30 and 40 is different because the marking is done at different levels.

According to another variant not shown, the machine 1 may comprise a single marking station. In this case, the positioning system 50 comprises a single pair of independent turrets. The platen 51 has a single turret, while the platen 52 has a single turret 70.

Preferably, the machine 1 comprises at least two marking stations with at least two pairs of turrets. In this case, each pair of turrets constitutes a station for marking an article 100 independently of the other pair or pairs or turrets. In the example in FIGS. 1 to 6, the support system 60 is a single one and shared by the different marking stations. Alternatively, each marking station may be associated with a support system 60 specific to the respective marking station. Each support system 60 is thus equipped with a respective marking station and movable with this marking station relative to the marking head 10.

According to another variant, not shown, each station may comprise a single turret for transporting an article 100. In this case, during the marking, the article 100 can be supported by this single carriage turret, or even be held by an additional turret. In other words, each marking station may comprise a means for supporting a single end of the article 100, or indeed a pair of means for supporting the ends of article 100.

According to another variant not shown, the X10 axis of the marking head 10 may be arranged horizontally, while the axis Y50 of the positioning system 50 is disposed vertically.

According to another variant not shown, the axis X10 of the marking head 10 and the axis Y50 of the system positioning 50 are both disposed vertically. For example, the positioning system 50 may be configured as a horizontal disk on which the axis A100 of the article 100 is oriented horizontally.

According to another variant not shown, the machine 1 may include a linear transport system instead of the pivoting transport system 50 shown in FIG. 1. In this case, the turrets may be mounted on parallel rails and be movable linearly in a direction perpendicular to the axis X10 of the marking head 10.

According to another variant not shown, the machine 1 may be adapted for marking articles having a non-cylindrical profile. For example, the article may include facets and present a generally polygonal cross section. According to another example, the article may be of a cuboidal shape, with a generally square or rectangular cross section. According to another example, the article may present an oval or conical cross section. The positioning system 50 and the support system 30 may then be specifically tailored to accommodate such articles.

Moreover, the technical characteristics of the various embodiments and variants proposed here above may, with respect to all or some of them, be combined. Thus, the machine 1 may be suitably adapted in terms of cost, functionality and performance.

Whatever be embodiment, the marking head 10 comprises a first roller 30 and a second roller 40 supported by the carriage 20 rotationally movable respectively about a first axis Y30 and a second Y40 axis each located in a plane perpendicular to the marking axis X10. These rollers 30 and 40 are provided for alternately marking one same article 100 or two successive articles 100 depending on the movements of the carriage 20.

The marking method according to the invention is described in detail here below, with reference made to various embodiments and variants envisaged here above.

The method comprises the following steps: a step a1) of positioning a first article 100 facing the marking head 10; a step a2) of marking the first article 100 under the action of the marking head 10; a step a3) of removal of the first article 100 by the first article 100 being moved away from the marking head 10; a step b1) of positioning a second article 100 facing the marking head 10; a step b2) of marking the second article 100 under the action of the marking head 10; a step a3) of removal of the second article 100 by the second article 100 being moved away from the marking head 10; and so on in a cyclical manner for successive articles 100 in a lot to be marked. Steps a1), a3), b1) and b3) are carried out via the positioning system 50. The step a3) and b1) can be simultaneous.

According to the invention, in the successive marking steps a2) and b2) the first roller 30 and the second roller 40 fitted to the marking head 10 both mark in alternating fashion every article 100 or mark in alternating fashion one article 100 out of two. In other words, depending on the configuration of the marking head 10 and the movements of the carriage 20 in the machine 1, the rollers 30 and 40 acting alternately: either in a first case, each in turn, mark the same article 100 in the step a2), then again in turn, mark the same article 100 in step b2); or in a second case, acting in turn, mark one article 100 out of two, for example with the roller 30 carrying out the marking in step a2), and then the roller 40 carrying out the marking in step b2).

In the first case where each article 100 is marked twice, the rollers 30 and 40 may be offset in relation to one another in a direction parallel to the axes Y30 and Y40 as in the embodiment in FIGS. 1 to 6, or indeed be aligned with one another in a direction perpendicular to the axes Y30 and Y40 according to the variant described here above but not shown.

When the rollers 30 and 40 are offset and mark each article 100 twice in each marking step a2) and b2), each roller 30 or 40 marks a different part 1033 or 1034 of the same article 100. The parts 1033 and 1034 are distinctly defined along the axis A100 of this article 100. In other words, each marking step a2) and b2) comprises two marking operations, carried out in turn by the rollers 30 and 40. Each article 100 is marked twice, once on its part 1033 and once on its part 1034. In the marking step a2), the carriage 20 is moved in a linear direction along the axis X10 in order to press the roller 30 against the part 1033 of the article 100, then in the reverse direction in order to draw away the roller 30 from the article 100, and then along the axis Z10 in order to position the roller 40 in front of the article 100, then along the axis X10 in order to press the roller 40 against the part 1034 of the article 100, then in the reverse direction in order to draw away the roller 40 from the article 100, then back again along the axis Z10 in order to position the roller 30 in front of the subsequent article 100 to be marked in step b2). The movements of the carriage 20 are comparable in the marking steps a2), b2) and subsequent steps.

When the rollers 30 and 40 are aligned and mark each article 100 twice in each marking step a2) and b2), each roller 30 or 40 marks one area of the article 100 having dimensions that are different from another area of this article 100 to be marked by the other roller 40 or 30. The two areas are located generally in the same part of the article 100 defined along its longitudinal direction. In other words, each marking step a2) and b2) comprises two marking operations, carried out in turn by the rollers 30 and 40, in two different areas of the same part of the article 100. In the marking step a2), the carriage 20 is moved in a linear direction along the axis X10 in order to press the roller 30 against the article 100, then in the reverse direction in order to draw away the roller 30 from the article 100, and then along the axis Z10 in order to position the roller 40 in front of the article 100, then along the axis X10 in order to press the roller 40 against the article 100, then in the reverse direction in order to draw away the roller 40 from the article 100, then back again along the axis Z10 in order to position the roller 30 in front of the subsequent article 100 to be marked in step b2). The rollers 30 and 40 descend to different levels along the axis X10 to mark each of the areas, with different speeds of rotation R10, as described here above. The movements of the carriage 20 are comparable in the marking steps a2), b2) and subsequent steps.

In the second case where each article 100 is marked once, the rollers 30 and 40 are generally aligned with each other along a direction perpendicular to the axes Y30 and Y40 and mark alternately the same part of two successive articles 100, defined along their longitudinal direction, in the successive marking steps a2) and b2). Each marking step a2) and b2) comprises one single marking operation, carried out by one of the rollers 30 or 40. In the marking step a2), the carriage 20 is moved in a linear direction along the axis X10 in order to press the roller 30 against the article 100, then in the reverse direction in order to draw away the roller 30 from the article 100, and then along the axis Z10 in order to position the roller 40 in front of the article 100 to be marked in step b2). In the marking step b2), the carriage 20 is moved in a linear direction along the axis X10 in order to press the roller 40 against the article 100, then in the reverse direction in order to draw away the roller 40 from the article 100, and then again along the axis Z10 in order to position the roller 30 in front of the article 100 to be marked in a subsequent marking step.

The method also includes, on the one hand, before each step a1) and b1), a step a0) or b0) of the loading of an article 100 to be marked into the positioning system 50 via the feeding system 5 and, on the other hand, after each step a3) and b3), a step a4) or b4) of the unloading of the article 100 that has been marked, out of the positioning system 50 and then out of the machine 1.

On account of the rollers 30 and 40, the machine 1 and the method according to the invention provide highly advantageous versatility.

The invention claimed is:

1. A marking machine for marking articles, the machine comprising a marking head suitable for applying a marking force on an article along a marking axis, the marking head comprising a carriage movable in translation along the marking axis and along a transverse axis which is oriented perpendicular to the marking axis, the marking head including a first roller and a second roller carried by the carriage, rotatable respectively around a first axis and a second axis each located in a plane oriented perpendicular to the marking axis, the rollers being capable of alternately marking the same article or two successive articles depending on movements of the carriage.

2. The marking machine according to claim 1, wherein the first roller and the second roller are offset relative to one another in a direction parallel to the first axis and the second axis, each roller configured to mark a different part of the same article in a longitudinal direction of the article.

3. The marking machine according to claim 2, further comprising a system for distributing plural distinct marking tapes between the article and the first roller or the second roller, respectively.

4. The marking machine according to claim 1, wherein the first roller and the second roller are aligned with each other along a direction oriented perpendicular to the first axis and the second axis and alternatingly mark a same part of plural successive articles, defined along a longitudinal direction of the articles.

5. The marking machine according to claim 1, wherein the carriage is movable along the marking axis alternatingly over a first distance for the first roller and a second distance for the second roller, the first distance being different from the second distance, each roller being capable of marking an area of an article having different dimensions from another area of the same article to be marked by the other roller, the different dimensions including a different diameter.

6. The marking machine according to claim 1, wherein the first axis and the second axis are situated in a same plane oriented perpendicular to the marking axis.

7. A method comprising:

positioning a first article facing a marking head;

marking the first article under the action of the marking head;

positioning a second article facing the marking head; and marking the second article under the action of the marking head;

wherein a first roller and a second roller of the marking head mark alternately both mark each article or each alternately mark one article out of two articles during marking of the first article and marking of the second article, wherein the first roller and the second roller are offset relative to one another along a direction parallel to the first axis and the second axis, each of the first and second roller marking a different part of the same article during marking of the first article and marking of the second article.

8. The method according to claim 7, wherein the first roller and the second roller alternately mark a same part of successive articles along a longitudinal direction of the articles during marking of the first article and marking of the second article.

9. The method according to claim 7, wherein the first and second rollers alternately mark two different areas of the same article in each of marking the first article and marking the second article, the two different areas being situated in a same part of the article defined along a longitudinal direction of the article and having different dimensions, the different dimensions including different diameters.

10. The marking machine according to claim 1, wherein the rollers separately mark different articles in successive articles.

11. The method according to claim 7, wherein marking the first article includes marking the first article by applying pressure onto a first marking tape with the first roller and marking the second article includes marking the second article by applying pressure onto one or more of the first marking tape or a second marking tape with the second roller.

12. A machine comprising:

a carriage holding a first roller that is rotatable around a First axis and a second roller that is rotatable around a second axis, the first roller rotatable to engage a first marking tape to print onto a first area of an article, the second roller rotatable to engage one or more of the first marking tape or a second marking tape to print onto a differently sized second area of the article, wherein the first axis of the first roller and the second axis of the second roller are offset from each other along a direction that is parallel to a third axis such that the first marking tape is engaged by the first roller and the article between the first roller and the article during printing on the first area of the article, and the one or more of the first marking tape or the second marking tape is engaged by the second roller and the article between the second roller and the article during printing on the differently sized second area of the article.

13. The machine of claim 12, further comprising a marking head that applies a marking force on the article via the first roller and the second roller.

14. The machine of claim 12, wherein the carriage also is movable in one or more directions parallel to one or more of the first axis or the second axis.

15. The machine of claim 12, wherein the first roller is offset relative to the second roller in a direction that is parallel to the first axis.

16. The machine of claim 12, wherein the first roller engages the first marking tape during printing on the article and the second roller engages the second marking tape during printing on the article.

17. The machine of claim 12, further comprising a support system positioned to support the article during printing on the article by the first roller and the second roller, wherein the one or more of the carriage or the support system moves a first distance in the first direction along the third axis to cause the first marking tape to be engaged by the first roller and the article between the first roller and the article during printing on the first area of the article, and the one or more of the carriage or the support system moves a different, second distance in the second direction along the third axis to cause the one or more of the first marking tape or the second marking tape to be engaged by the second roller and the article between the second roller and the article during printing on the differently sized second area of the article.

18. The machine of claim 17, wherein the support system includes one or more carriage-turrets engageable with the article to rotate the article relative to the carriage during printing on the article by the first roller and during printing on the article by the second roller.

19. The machine of claim 12, wherein the third axis is perpendicular to the first axis and to the second axis.

* * * * *